US006476570B1

(12) United States Patent
Pasini et al.

(10) Patent No.: US 6,476,570 B1
(45) Date of Patent: Nov. 5, 2002

(54) DEVICE AND PROCESS FOR CONTROLLING THE MOTOR DRIVES OF TEXTILE MACHINES

(75) Inventors: Giovanni Battista Pasini, Palazzolo Sull'Oglio (IT); Cesare Marella, Palazzolo Dull'Oglio (IT); Gian Mario Baitelli, Palazzolo Sull'Oglio (IT)

(73) Assignee: Marzoli S.p.A., Palazzolo Sull'oglio (IT)

( * ) Notice: Subject to any disclaimer, the term of this patent is extended or adjusted under 35 U.S.C. 154(b) by 0 days.

(21) Appl. No.: 09/625,451

(22) Filed: Jul. 26, 2000

(30) Foreign Application Priority Data

Jul. 29, 1999 (IT) ..... MI99A1693

(51) Int. Cl.[7] ..... H02P 1/54

(52) U.S. Cl. ..... 318/34; 318/41; 318/49; 318/66; 57/92; 57/93; 57/96; 242/352.1

(58) Field of Search ..... 318/34, 41, 49, 318/66; 242/352.1; 57/321, 92, 93, 96

(56) References Cited

U.S. PATENT DOCUMENTS 3,744,035 A * 7/1973 Geirhos et al. ..... 340/172.5
4,219,288 A * 8/1980 Gordemer et al. ..... 406/28
5,022,123 A * 6/1991 Ueda et al. ..... 19/260
5,090,452 A * 2/1992 Benelli ..... 139/100
5,113,123 A * 5/1992 Noser et al. ..... 318/106
5,304,900 A * 4/1994 Hayazaki et al. ..... 318/34
5,400,582 A * 3/1995 Hartmeier et al. ..... 57/264
5,463,557 A * 10/1995 Nakano et al. ..... 364/470
5,815,889 A 10/1998 Barth et al. ..... 19/240

FOREIGN PATENT DOCUMENTS

EP 0669414 A1 8/1995
GB 2034764 A 6/1980
GB 2151664 A 7/1985

* cited by examiner

*Primary Examiner*—Robert E. Nappi
*Assistant Examiner*—Rina I. Duda
(74) *Attorney, Agent, or Firm*—Hedman & Costigan, P.C.

(57) ABSTRACT

A device and a process for controlling the motor drives (121) of textile machines, comprising at least one "encoder" (101), capable of controlling the number of revolutions of each motor (121), and at least one central electronic unit (111) processing the data originating from all the motor drives (121), based on an application program containing the synchronizing data between the individual motors (121) and the technological operating parameters of the textile machine.

7 Claims, 2 Drawing Sheets

DEVICE AND PROCESS FOR CONTROLLING THE MOTOR DRIVES OF TEXTILE MACHINES

BACKGROUND OF THE INVENTION

1. Field of the Invention

This invention refer to a device and a process for controlling the motor drives of textile machines.

In a textile machine, such as for instance a fly frame In a textile machine, such as for instance a fly frame or a continuous ring frame, it is presently common to subdivide the mechanical controls of the machine's working organs and to apply individual motor drives, for instance by using some "brushless" or asynchronous motors; these motor drives are controlled by their own systems ("inverters"), whose purpose is to ensure that every working organ of the textile machine follows their rules of motion, based on certain production parameters (such as for instance the count and the twists per inch of the yarn to be produced) set up on an application program loaded on a central computer, which takes care of synchronizing the individual motor drives.

The synchronization between the individual motor drives and the method for maintaining the synchronization of the working organs within certain tolerance limits acceptable for operating the machine have recently formed the object of studies in the branch, which have engendered the production of specific processing equipment and application programs, with the inevitable consequence of appreciably adding to the costs of designing, producing and operating textile machines.

A further designing effort has led to create systems and processes capable of controlling the operation of electronically guided textile machines, based on the working parameters of the machines themselves; in the specific case, some methods for synchronizing and controlling the motor drives of fly frames are known, where the tension of the slubbing in its aerial path is due to an abnormal behavior of the twisting flyer through which it passes before being laid down on the spool by the flyer's compressor, and certain systems synchronizing and controlling the motor drives of continuous ring frames, where the speed of motion of the ring carrier and the speed of the spools are proportional to the geometry of the yarn's "balloon".

2. Description of Related Art

The traditional control systems comprise "closed loop" systems including a number of sensors placed on the machine's working organs (for example, for the monitoring of the revolutions of the spools on a continuous fly frame), capable of transmitting the signal needed to correct the nominal revolutions of each motor drive to a processor; alternatively, the motor drives of textile machines employ some control systems of a "master/slave" type, where a reference signal is used to control the revolutions of all the textile machine's motor drives.

However, such control processes are only based on a single reference signal, sensed by a special working organ of the textile machine; consequently, in case of a failure or a malfunction of an organ providing the reference signal, the machine operates without observing the production parameters set up in the application management program for the motor drives, despite maintaining a synchronization between this reference organ and the remaining working organs of the overall textile machine.

BRIEF SUMMARY OF THE INVENTION

The purpose of this invention is therefore to overcome the mentioned drawbacks, and in particular to offer a device and a process for controlling the motor drives of textile machines, so as to ensure their safety and reliability, while not requiring the use of particularly complex or overly expensive technologies with respect to those of the known art, in relation to the available advantages.

In particular, a further purpose of this invention is to offer a device and a process for controlling the motor drives of continuous ring frames and fly frames, capable of reducing their manufacturing and operating costs with respect to those of similar machines of a traditional design.

These and other purposes are achieved by a device for controlling the motor drives of textile machines thereby increasing their efficiency, productivity and reliability.

In an advantageous manner, the use of the process according to this invention automatically eliminates the loss of time due to the stoppage of the spools or of the drawing cylinders, because of failures or malfunctions during the textile spinning, winding or other phases, with respect to those of the known technologies.

This consequently generates a greater productivity of yarn spinning with respect to that of the known art, because of the complete automation of the control process and of the relative spinning, winding and other systems; finally the manufacturing and operating costs during the production of the yarn are relatively moderate with respect to those of the known art, in relation to the advantages thus obtained.

Further purposes and advantages of this invention will become evident from the description and the attached drawings to follow, supplied for purely explanatory and non-limiting purposes, in which:

Figure 1:
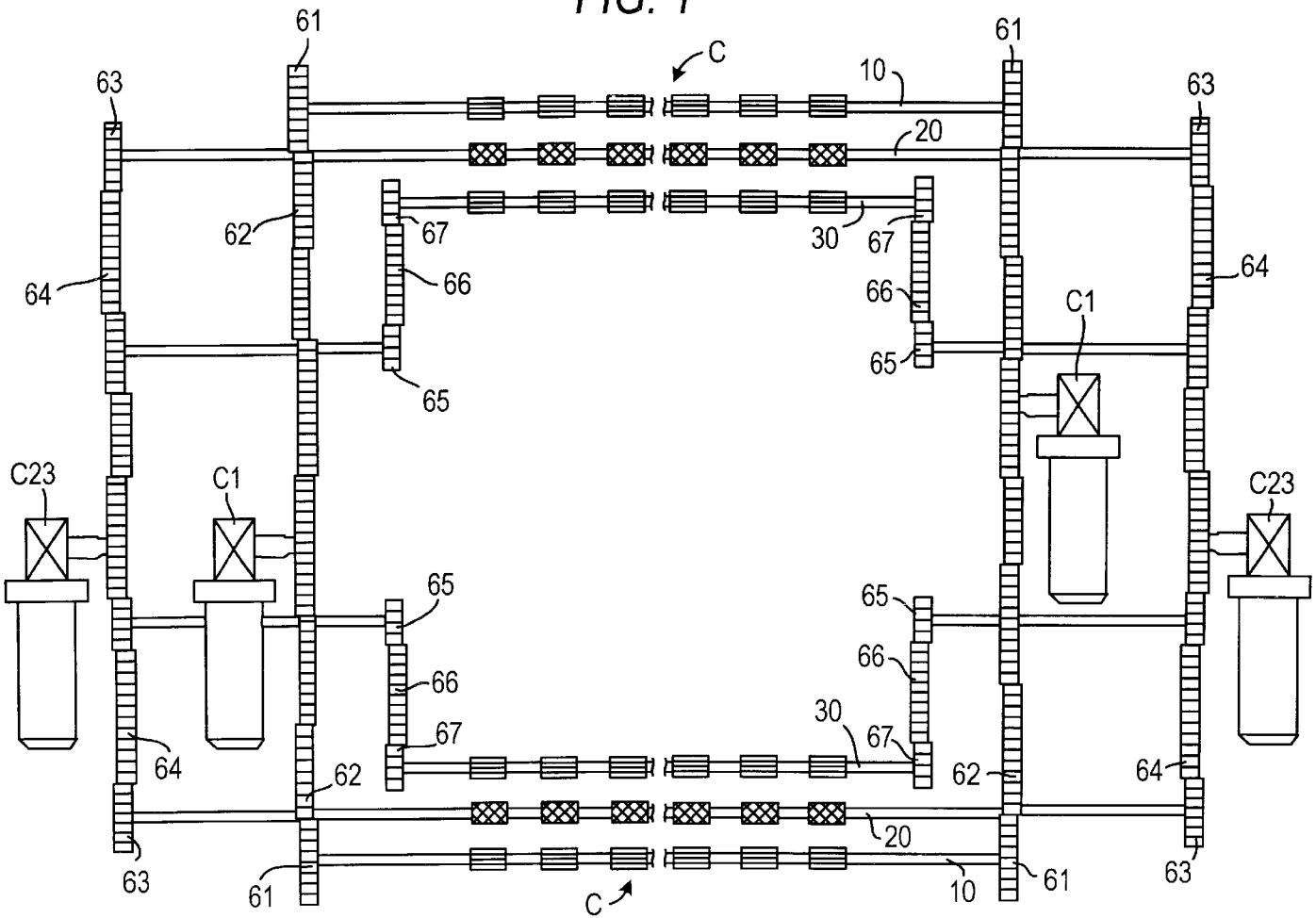
FIG. 1 shows a simplified ground view of the cylinder assembly of a textile machine comprising a device for controlling its motor drives according to this invention.

DETAILED DESCRIPTION OF THE INVENTION particular reference to FIG. 1, C indicates a cylinder assembly of a spinning machine (continuous ring frame), in which a pair of primary actuators C1, controlled by their relative actuators, controls a motor drive on each side of the frame, while a pair of secondary and tertiary actuators C23, which derive their motion from a single "brushless" type motor, control a further motor drive of the textile machine.

As is known, the cylinder system C of a continuous ring frame is constituted by a series of fiber drawing devices, which happen to be present in a number equal to the number of the spindles set up side by side on one or the other fronts of the machine; in the case of FIG. 1, the outlet drawing cylinders, indicated by the number 10, are pressed from the top by the pressure rollers (not shown in the Figure), and the row of intermediate drawing cylinders 20 are controlled by some kynematic devices including among others the gears 63, 64, while the gears 65, 66, 67 control the row of the inlet drawing cylinders 30; even the rows of the drawing cylinders 20, 30 are provided with a series of pressure rollers (not shown in the figures for simplicity).

The drawing cylinders 10, 20, 30 are synchronized between each other and positively controlled, while the pressure rollers are idle; in this case, the drawing of the fibers is effected by the difference of the peripheral velocities of the inlet cylinders 30, the intermediate cylinder 20 and the outlet cylinder 10 and by the fact that the fibers happen to be grasped between the upper pressure rollers and the relative lower cylinders 30, 20, 10.

In order to achieve a desired drawing ration, the ratio of the revolutions between the cylinders 20, 30 is kept constant by the actuators C23 and is represented by a value which can be set up by a user, while the ratio between the number of revolutions between the second cylinder 20 and the first cylinder 10 is variable and can at any rate be set by a user.

The data for setting up the values of the ratio between the number of revolutions of the drawing cylinders 10, 20, 30 are constituted by some inlet variables in a given application program, which takes care of managing the "brushless" motor drives.

In particular, the controlling device for these motor drives produced according to this invention allows, in the case on hand, to control the drawing device of the continuous ring frame for the production of a yarn known as a flashed or fantasy yarn (for example, for curtains, tablecloths, and apparel.

The particular geometric characteristic of the flashed yarn distinguishes the visual appearance of its fabric, because it is constituted by a yarn formed by fibers of a specific length and a regular change of their cross-section; the periodical variation of the yarn's cross-section, which equals a restriction of the fibers in a given length of the yarn itself, determines an irregularity in the yarn, known as a flash due to its characteristic geometric form. When the length between two subsequent flashes is constant, the yarn has a regular flash, while if the length varies in a casual manner the yarn is said to have an irregular flash.

In order to produce a flashed yarn directly in the continuous ring frame, meaning while the fibers are still in the physical state of a drawable stubbing and not of a finished yarn, it is necessary to vary the feeding of the fibers subjected to the drawing action of the cylinder assembly, as they are delivered from the second cylinder 20 to the first cylinder 10.

Because of the fact that the control of the first cylinder 10 is synchronized by the actuator C1 with that of the second cylinder 20 as well as by the actuator C23 with that of the third cylinder 30, it is possible, by allowing the ratio between the nominal revolutions of the second cylinder 20 and that of the first cylinder 10 to fluctuate appropriately, to obtain a change in the feeding rate of the fibers delivered by the second cylinder 20 to the first cylinder 10.

If the value of the ratio of the revolutions between the second cylinder 20 and the first cylinder 10 fluctuates with a regular amplitude, the flash produced in the yarn will be of a regular type, meaning that every flash is separated by a constant interval over the entire length of the yarn, while if said value fluctuates with an irregular amplitude the flashing of the yarn will turn out to be irregular.

The same process according to the invention can similarly be applied to a fly frame, so as to continuously control the tension of the yarn while the stubbing winds up on a spool in a spinning frame, before removing the spools from the frame. In this case, the control of the actuators (for the number of revolutions of the spindles and of the cylinder C, for the linear speed and accelerations of the spindle carrying block) is a function of a vector measured in the aerial path of the slubber, and this vector corresponds to the traction force of the slubber.

Moreover, the process may be similarly be applied to a continuous ring frame, so as to set up the linear speeds and accelerations of the ring-carrying block and the rotation of the spindles, for each spinning count to be produced and independently from the machine's other motor drives, so as to lay down more loops of yarn on the spool, and therefore increase the machine's productivity.

Figure 2:
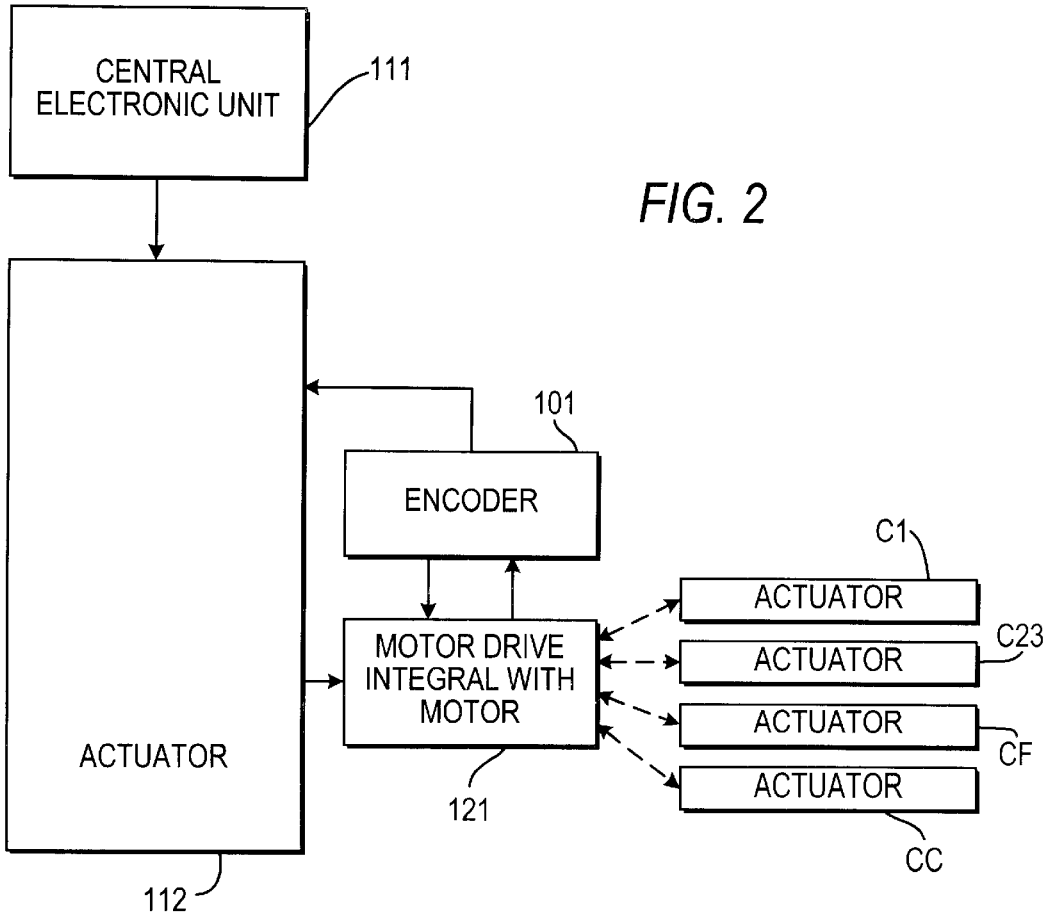
FIG. 2 shows a block diagram of the controlling process according to the invention. C1 and C23 represent actuators that may be used with the cylinder assembly of a spinning textile machine. CF and CC represent actuators that may be used with the spindles or blocks of a textile machine.

In effect, the device actuating this process according to the invention allows controlling the motor drives (integral with "brushless" or asynchronous, alternate current motors) indicated in a simplified manner by the number 121 in FIG. 2, of machines such as the fly frames or continuous ring frames previously described, so as to appropriately control the actuators C1, C23 of the cylinder assembly of a spinning machine, or the actuators CF, CC of the spindles or blocks of other textile machines.

In particular, every motor drive 121 of the textile machine is equipped with an "encoder" 101 for measuring and controlling the number of revolutions completed by the mentioned motor drive 121, moreover, a central electronic unit 111 processes the signals originating from all the motor drives 121 and compares them with a series of synchronizing data between the individual motor drives 121 and the machine's technological parameters stored in an application program memorized in the central unit 111.

The regulation of the nominal number of revolutions N2, relating to a given motor drive 121 occurs is such a manner that the "encoder" 101, after sensing the number of revolutions N1 of its own motor drive 121, communicates the number of revolutions of the actuator 112 (usually constituted by an "inverter" connected to the same, which is in turn connected with the respective actuator C1, C23, CF, CC); at this point, the actuator 112 performs a differential operation ($\Delta$=N−N1) between the number of revolutions N1 communicated by the "encoder" 101 and the nominal number of revolutions N transmitted by the central processing unit 111 and depending on the machine's technological operating parameters, such as the count, the yarn production in meters per minute and the twist per inch.

In a subsequent step, the electronic actuating device 112 sets N2 (the true number of revolutions of the motor drive 121) equal to the sum between N (the ideal number of revolutions of the motor drive 121, memorized in the application program inserted into the unit 111) and $\Delta$N, and therefore corrects, by adding or subtracting, the number of revolutions of the motor drive 121, so as to cancel out the mentioned differential value $\Delta$N.

In particular, the ideal condition necessary is that in which the $\Delta$N limit, for a time t tending to zero, must cancel itself out, and therefore, in the cases where on the contrary said limit turns out to be greater (N2>N) or smaller (N2<N) than zero, the number of revolutions of the motor 121 corresponding to the actuator 112 must be respectively decreased or increased.

Finally, in the case in which N2=N, there will obviously be no corrective action of the number of revolutions on the part of the actuator 112.

The above description clarifies the characteristics and the advantages of the device and of the process for controlling the motor drives of textile machines as an object of this invention.

In particular, they include the following aspects:

reduced losses of time due to the stoppages of the spindles or of the drawing cylinders, because of failures or malfunctions during the spinning, winding or other treatments, with respect to the known technologies, greater productivity of yarn spinning, with respect to that of a known art, possibility of automating the spinning, weaving or other systems, lower costs of building and operating the textile machines, with respect to those of a known art.

It is evident that further variations may be applied to the process for controlling the motor drives of textile machines and their relative actuating devices as an object of this invention, without thereby abandoning the principles of novelty inherent in the inventive idea, just as it is evident that, in the practical implementation of the product derived from the new method, the materials, shapes and sizes of the illustrated details may be of any kind, depending on the requirements, and that the same may be replaced by others of a technically equivalent kind.

What is claimed is:

1. A process for controlling a plurality of motor drives (121) integral with motors of textile machines, characterized in that it contains the following phases:

regulation of the nominal value of revolutions relating to a given motor drive (121), so that a measuring and controlling device (101) can, after sensing the true value of the revolutions of said motor drive (121), communicate said true number of revolutions to an actuating device (112) connected to the same and to its respective actuating device (C1, C23, CF, CC), a performance, on the part of said actuating device (112), of a deferential operation between said true number of revolutions received from said measuring and controlling device (101) and said nominal number of revolutions transmitted by a central electronic unit (111) and depending on the technological operating parameters of said textile machine, an initialization, on the part of said actuating device (112), of said true number of revolutions of the said motor drive (121), which turns out to be equal to the sum of said ideal number of revolutions, memorized inside an application program of said central electronic unit (111) and a value resulting from said differential operation, a correction, on the part of said actuating device (112), of said true number of revolutions of said motor drive (121) so as to cancel out said value resulting from said differential operation, a limiting amount of said value resulting from said differential operation, for an infinitesimal instant and therefore tending to be zero, if said limiting amount turns out to be greater or smaller than zero, said true number of revolutions of said motor drive (121) is respectively decreased or increased on the part of said actuating device (112), if said limiting. amount turns out to be equal to zero, said actuating device (112) does not take any action to correct said true number of revolutions.

2. A device for controlling a plurality of motor dives (121) integral with motors of textile machines according to claim 1, characterized in that said textile machines comprise some continuous ring frames and fly frames.

3. A process for controlling the motor drives (121) of continuous ring frames according to claim 2, characterized in that a pair of primary actuators (C1), controlled by their relative actuating devices (112), controls a first motor drive (121) for each side of said spinning frame, while a pair of second and third actuators (C23), deriving their motion from a motor integral with said first motor dive (121), control a second motor drive (121) of said spinning frame, in which a drawing action of the fibers is obtained thanks to the difference between the peripheral velocities of the inlet cylinders (30), the intermediate (20) and the outlet cylinders (10) of said fibers, which happens to be grasped between some pressure rollers and said cylinders (10, 20, 30).

4. A process for controlling the motor drives (121) of textile machines according to claim 3, characterized in that, in order to achieve a desired drawing ratio, the ratio between the number of revolutions of said intermediate cylinders (20) and inlet cylinders (30) is kept constant by said second and third actuators (C23), and is represented by a value which can be set up by a user, while the ratio between the number of revolutions of said intermediate cylinders (20) and the outlet cylinders (10) happens to be variable and can in any case be set up by a user.

5. A process for controlling the motor drives (121) of textile machines according to claim 4, characterized in that the values of said ratio between the number of revolutions of said drawing cylinders (10, 20, 30) capable of being set up are constituted by the inlet variables of a given application program, relating to the management of said actuating devices (112).

6. A device for controlling the motor drives (121) of textile machines according to claim 2, characterized in that said controlling device controls a drawing unit of said continuous ring frame for the production of flashed or fantasy yarn, having a regular or irregular flash.

7. A process for controlling the motor drives (121) of textile machines, having continuous ring frames for the production of flashed yarn according to claim 6, characterized in that it comprises a further phase in which, because of the fact of the control of a first cylinder (10) is synchronized by a first actuating device (C1) with that of a second cylinder (20) and by a second actuating device (C23) with that of a third cylinder (30), the value of the ratio between a nominal number of revolutions of said second cylinder (20) and that of said first cylinder (10) is appropriately variable, so as to obtain a regular or irregular variation of the feeding of the fibers delivered by said second cylinder (20) to said first cylinder (10).

* * * * *